US011043161B2

(12) United States Patent
Chen et al.

(10) Patent No.: US 11,043,161 B2
(45) Date of Patent: Jun. 22, 2021

(54) CONTROL CIRCUIT FOR PANEL

(71) Applicant: NOVATEK Microelectronics Corp., Hsin-Chu (TW)

(72) Inventors: I-Feng Chen, Miaoli County (TW); Zhen-Guo Ding, Tainan (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 77 days.

(21) Appl. No.: 16/559,595

(22) Filed: Sep. 3, 2019

(65) Prior Publication Data

US 2021/0065613 A1 Mar. 4, 2021

(51) Int. Cl.
*G09G 3/32* (2016.01)

(52) U.S. Cl.
CPC ..... *G09G 3/32* (2013.01); *G09G 2310/0202* (2013.01); *G09G 2320/0257* (2013.01); *G09G 2330/08* (2013.01)

(58) Field of Classification Search
CPC ..... G09G 3/32; G09G 2310/0202; G09G 2320/0257; G09G 2330/08
See application file for complete search history.

(56) References Cited

U.S. PATENT DOCUMENTS 7,808,456 B2 * 10/2010 Chen ..... G09G 3/3216 345/76
2016/0260375 A1 * 9/2016 Ruan ..... G09G 3/32

* cited by examiner

*Primary Examiner* — Alexander Eisen
*Assistant Examiner* — Nathaniel P Brittingham
(74) *Attorney, Agent, or Firm* — Winston Hsu

(57) ABSTRACT

The invention discloses a control circuit for controlling a panel. The panel includes a plurality of light-emitting elements arranged as an array. Each row of light-emitting elements among the plurality of light-emitting elements are coupled to each other via one of a plurality of scan lines. The control circuit includes a current source, an emission switch, a plurality of scan switches and a level adjustment circuit. The current source is coupled to a column of light-emitting elements among the plurality of light-emitting elements. The emission switch is coupled to the current source and the column of light-emitting elements. Each of the plurality of scan switches is coupled to one of the column of light-emitting elements via one of the plurality of scan lines. The level adjustment circuit is coupled between the plurality of scan lines and the current source.

9 Claims, 14 Drawing Sheets

CONTROL CIRCUIT FOR PANEL

BACKGROUND OF THE INVENTION

1. Field of the Invention

The present invention relates to a control circuit for controlling a panel, and more particularly, to a control circuit for controlling a light-emitting diode (LED) panel.

2. Description of the Prior Art

Light-emitting diodes (LEDs) are widely used in displays of electronic devices such as television screens, computer monitors, portable systems such as mobile phones, handheld game consoles and personal digital assistants (PDAs). A down-ghost image is a problem commonly appearing in the LED panels. In general, a conventional LED panel includes an array of LED pixels, which are scanned row by row (e.g., from up to bottom) to show intended images. The LED in each pixel may be controlled to emit light or not in each scan cycle. If a first LED of a scan line is configured to emit light in a present scan cycle, the parasitic capacitor coupled to the cathode of the LED may be discharged to a lower voltage level by the current source supplying current for light emission. In the next scan cycle, an adjacent second LED of the next scan line is configured to not emit light. However, when this next scan line is conducted and couples the anode of the second LED to a high power supply voltage. The forward-bias voltage between the anode and cathode of the second LED may turn on the second LED and make it emit light for a short moment. This short emission may generate a weak image below the normal image which has been scanned in the previous scan cycle, as the so-called down-ghost phenomenon.

Thus, there is a need to provide a method and apparatus for preventing the LEDs from being wrongly turned on, so as to solve the down-ghost problem.

SUMMARY OF THE INVENTION

It is therefore an objective of the present invention to provide a control circuit for a panel such as a light-emitting diode (LED) panel, to prevent or mitigate the down-ghost problem.

An embodiment of the present invention discloses a control circuit for controlling a panel. The panel comprises a plurality of light-emitting elements arranged as an array. Each row of light-emitting elements among the plurality of light-emitting elements are coupled to each other via one of a plurality of scan lines. The control circuit comprises a current source, an emission switch, a plurality of scan switches and a level adjustment circuit. The current source is coupled to a column of light-emitting elements among the plurality of light-emitting elements. The emission switch is coupled to the current source and the column of light-emitting elements. Each of the plurality of scan switches is coupled to one of the column of light-emitting elements via one of the plurality of scan lines. The level adjustment circuit is coupled between the plurality of scan lines and the current source.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
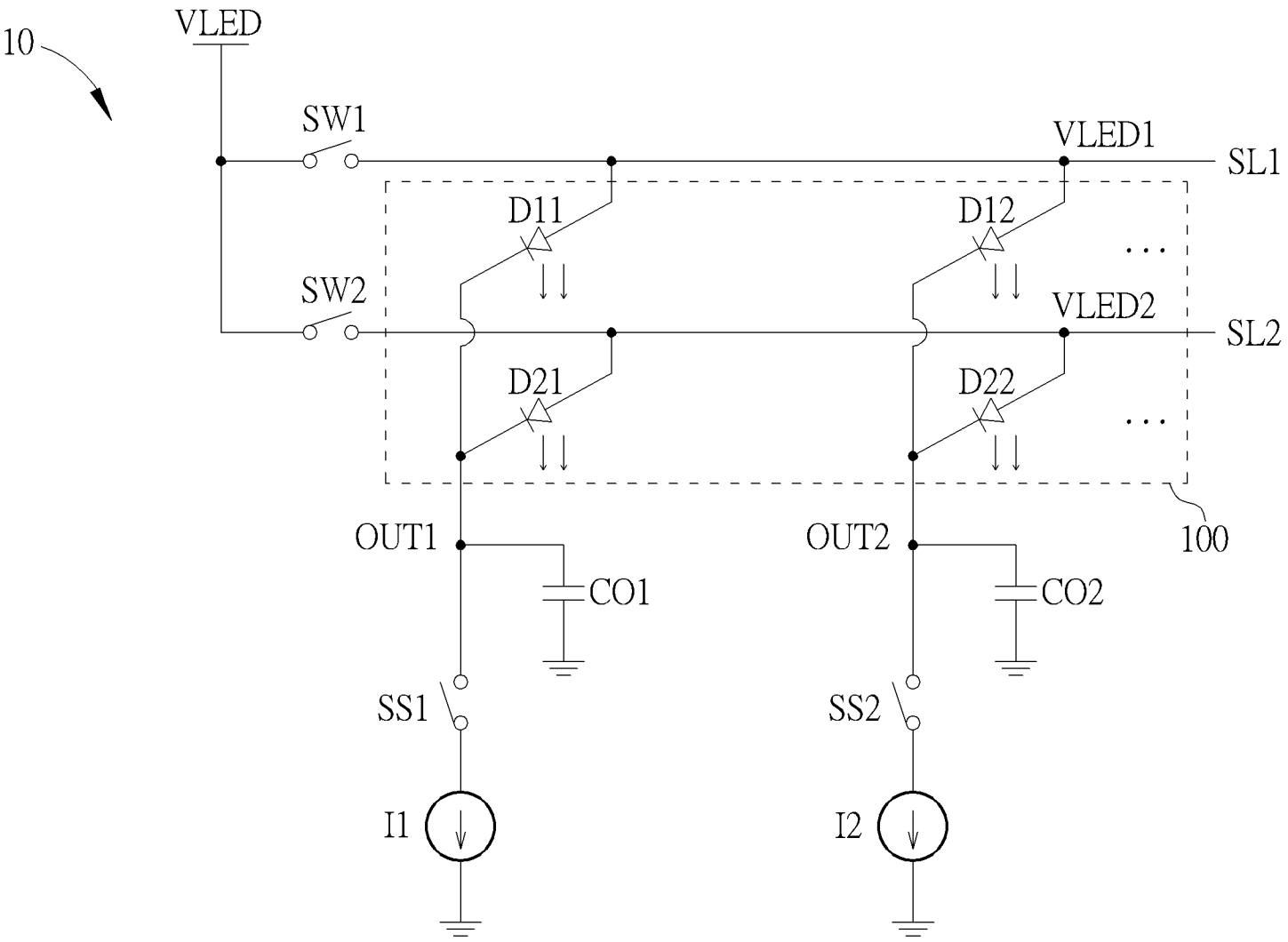
FIG. 1 is a schematic diagram of a general display device.

Please refer to FIG. 1, which is a schematic diagram of a general display device 10. As shown in FIG. 1, the display device 10 includes a panel 100, scan switches SW1 and SW2, emission switches SS1 and SS2, and current sources I1 and I2. The panel 100 may include hundreds or thousands of light-emitting elements arranged as an array, while FIG. 1 only illustrates two rows and two columns of light-emitting elements for brevity. Each light-emitting element may be a light-emitting diode (LED) as shown in FIG. 1. Those skilled in the art should understand that the light-emitting element may be any other type of circuit element capable of emitting light. To facilitate the illustration and description, in the following embodiments, the light-emitting elements are implemented with LEDs.

In the panel 100, two rows and two columns of LEDs D11, D12, D21 and D22 are illustrated. The anode of each row of LEDs may be coupled to a scan line SL1 or SL2, and further coupled to the scan switch SW1 or SW2 via the scan line SL1 or SL2. The scan lines SL1 and SL2 are respectively controlled by the scan switches SW1 and SW2 to be scanned row by row. The scan operation means that the corresponding scan switch SW1 or SW2 is turned on to forward the power supply voltage VLED to the anode of the row of LEDs. For example, in a first scan cycle, the scan switch SW1 may be turned on to forward the power supply voltage VLED to the anode of the LEDs D11 and D12, and in a second scan cycle following the first scan cycle, the scan switch SW2 may be turned on to forward the power supply voltage VLED to the anode of the LEDs D21 and D22.

In the panel 100, each column of LEDs are commonly coupled to the current source I1 or I2, and the emission switch SS1 or SS2 may be coupled between the current source I1 or I2 and the corresponding column of LEDs. During the scan period, if the LED coupled to the corresponding scan line is configured to emit light, the corresponding emission switch may be turned on, allowing the current source to supply current for light emission of LED. The turned-on time length of the emission switch may be predetermined, to control the brightness of the pixel in this scan period. On the other hand, if the LED coupled to the corresponding scan line is configured to not emit light, the corresponding emission switch may be turned off; hence, the LED will not emit light without current supply. As shown in FIG. 1, each column of LEDs are further coupled to a capacitor CO1 or CO2, which is a parasitic capacitor of the circuit elements and/or connecting wires.

Figure 2:
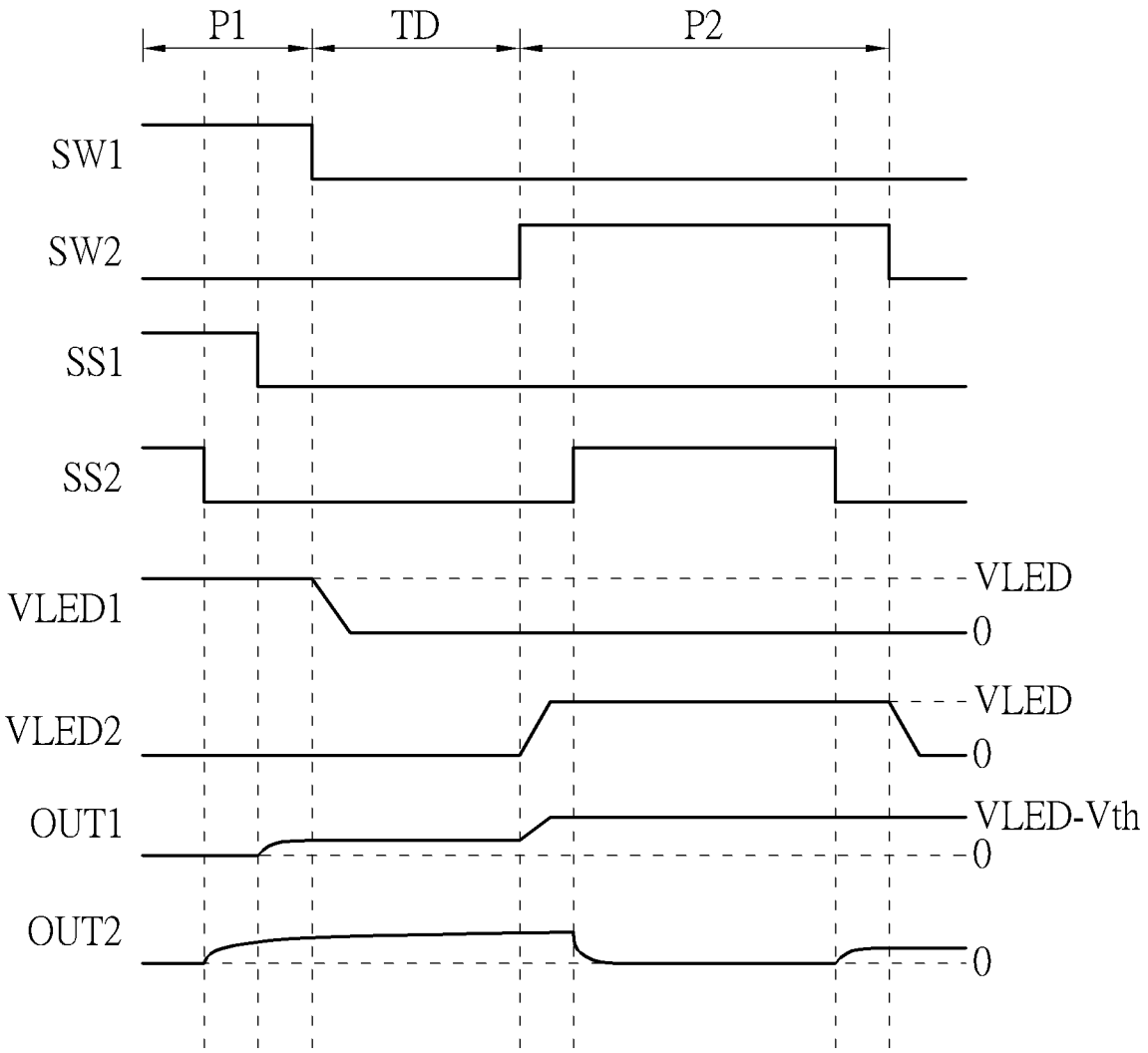
FIG. 2 is a waveform diagram of related voltages and switch statuses as shown in FIG. 1.

Please refer to FIG. 2, which is a waveform diagram of related voltages and switch statuses as shown in FIG. 1. FIG. 2 illustrates a transition of scan periods, where the scan period P1 ends and then the scan period P2 starts after a dead interval TD. As for the control signals of the switches SW1, SW2, SS1 and SS2, the "high" pulse stands for turned-on and the "low" pulse stands for turned-off. During the scan period P1, the scan switch SW1 is turned on, to forward the power supply voltage VLED to the node VLED1 coupled to the anode of the row of LEDs D11, D12 . . . , etc. In this scan period, both of the LEDs D11 and D12 are configured to emit light; hence, both of the emission switches SS1 and SS2 are turned on, allowing the currents of the current source I1 and I2 to be supplied to the LEDs D11 and D12, respectively. The turned-on switches SS1 and SS2 may control the nodes OUT1 and OUT2 (which is respectively coupled to the cathode of the LEDs D11 and D12) to achieve a lower voltage approximately equal to zero voltage (illustrated as zero voltage in FIG. 2), allowing the LEDs D11 and D12 to be fully turned on to emit light. After the emission switches SS1 and SS2 are turned off, the voltages of the nodes OUT1 and OUT2 gradually rise. However, the parasitic capacitors CO1 and CO2 limit the rising speed of voltages of the nodes OUT1 and OUT2. As shown in FIG. 2, before the end of the scan period P1, the emission switch SS1 is turned off later, and thus the voltage of the node OUT1 does not have enough time to rise to a proper level; instead, the voltage of the node OUT1 may remain at a lower level.

Subsequently, in the next scan period P2, the scan switch SW2 is turned on, to forward the power supply voltage VLED to the node VLED2 coupled to the anode of the next row of LEDs D21, D22 . . . , etc. In this scan period, the LED D21 is configured to not emit light; hence, the emission switch SS1 is turned off. When the scan switch SW2 starts to be turned on, the voltage of the node VLED2 correspondingly rises. At this moment, since the voltage of the node OUT1 remains at a lower level, there is a forward-bias voltage on the LED D21, resulting in unwanted light emission of the LED D21. This light emission may appear until the voltage of the node OUT1 is drawn to a higher level such as the power supply voltage VLED minus the threshold voltage of D21, Vth, to cut off the LED D21. The short-term light emission of the LED 21 may generate a down-ghost image. As mentioned above, the unwanted down-ghost image usually appears below the normal image that may pull the cathode voltage of the LED to a lower level in the previous scan period, and thus called "down-ghost".

In order to prevent the down-ghost problem, the embodiments of the present invention provide a level adjustment circuit, which may be coupled between the scan lines SL1 and SL2 and the corresponding current source I1 or I2, respectively. The level adjustment circuit may be configured to control the voltage level of the node OUT1 or OUT2 coupled between the cathode of the LEDs and the current source I1 or I2.

Figure 3:
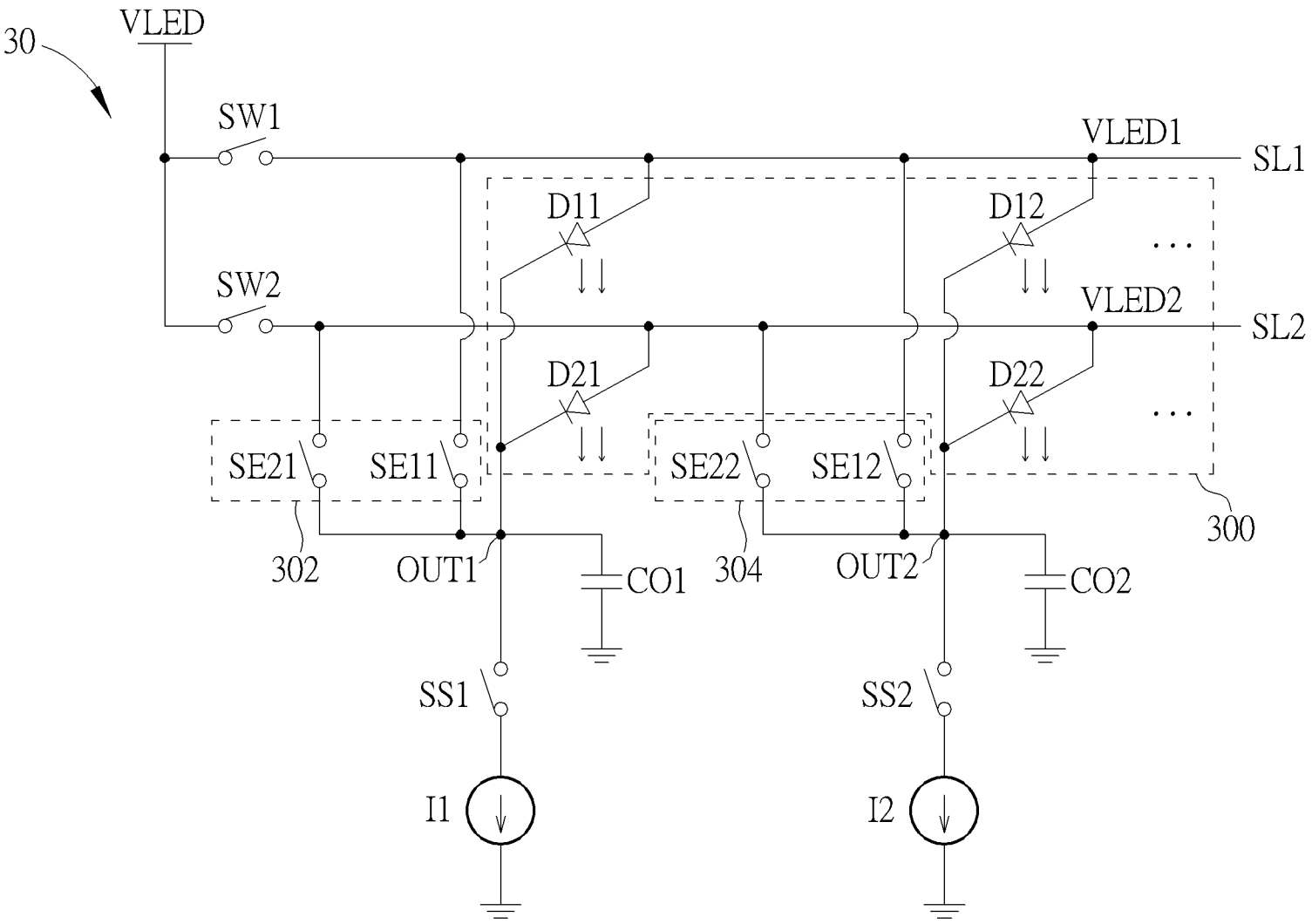
FIG. 3 is a schematic diagram of a display device according to an embodiment of the present invention.

Please refer to FIG. 3, which is a schematic diagram of a display device 30 according to an embodiment of the present invention. As shown in FIG. 3, the display device 30 includes a panel 300 and several circuit elements such as the scan switches SW1 and SW2, the emission switches SS1 and SS2, and the current sources I1 and I2, which are identical to the circuit elements in the display device 10 shown in FIG. 1 and thus denoted by the same symbols. The difference between the display device 30 and the display device 10 is that, the display device 30 further includes level adjustment circuits 302 and 304, which are configured to control the voltage levels of the nodes OUT1 and OUT2, respectively, as the cathode voltage of a column of LEDs. Note that the panel 300 may include hundreds or thousands of LEDs arranged as an array, and the related circuit elements such as the switches, the current sources and the level adjustment circuits may be disposed accordingly. In detail, if there are M rows of LEDs in the panel 300, M scan switches SW1, SW2 . . . , etc. may be disposed in the display device 30. If there are N columns of LEDs in the panel 300, N emission switches SS1, SS2 . . . , etc., N current sources I1, I2, . . . , etc., and N level adjustment circuits 302, 304 . . . , etc. may be disposed in the display device 30. In an embodiment, these circuit elements such as the scan switches SW1, SW2 . . . , the emission switches SS1, SS2 . . . , the current sources I1, I2, . . . , and the level adjustment circuits 302, 304 . . . may be implemented in a control circuit such as implemented as an image control integrated circuit (IC) in a chip. The image control IC may receive image data from a host, and control the operations of the switches to show an intended image on the panel 300 according to the image data and also control the operations of the level adjustment circuits to prevent the occurrence of down-ghost images.

As shown in FIG. 3, each level adjustment circuit 302 or 304 includes a plurality of short-circuit switches, and each of the short-circuit switches is coupled between the corresponding current source, the corresponding column of LEDs and one of the scan lines SL1 or SL2. For example, the level adjustment circuit 302 includes short-circuit switches SE11 and SE21, where the short-circuit switch SE11 is coupled between the current source I1, the cathode of the column of LEDs (D11 and D21) and the scan line SL1, and the short-circuit switch SE21 is coupled between the current source I1, the cathode of the column of LEDs (D11 and D21) and the scan line SL2. The level adjustment circuit 304 includes short-circuit switches SE12 and SE22, where the short-circuit switch SE12 is coupled between the current source I2, the cathode of the column of LEDs (D12 and D22) and the scan line SL1, and the short-circuit switch SE22 is coupled between the current source I2, the cathode of the column of LEDs (D12 and D22) and the scan line SL2. Note that if the panel 300 has M rows of LEDs, each level adjustment circuit may include M short-circuit switches, where a terminal of the M short-circuit switches is coupled to the cathode of the column of LEDs, and another terminal of each of the M short-circuit switches is coupled to one of the M scan lines and the anode of one of the M rows of LEDs.

As mentioned above, the down-ghost image appears when a LED which is configured not to emit light has weak light emission since the cathode of the LED remains at a lower voltage level due to normal display operation in the previous scan period. In order to prevent the occurrence of down-ghost image, the cathode voltage of the LED may be pulled to a higher level before or when the scan period starts. In the level adjustment circuits 302 and 304 shown in FIG. 3, each short-circuit switch provides a short-circuit path between one of the nodes OUT1 and OUT2 and one of the scan lines SL1 and SL2, allowing the cathode and anode of the target LED to be short-circuited, so that the cathode voltage may follow the anode voltage and this LED may not emit light to generate the down-ghost image.

Figure 4A:
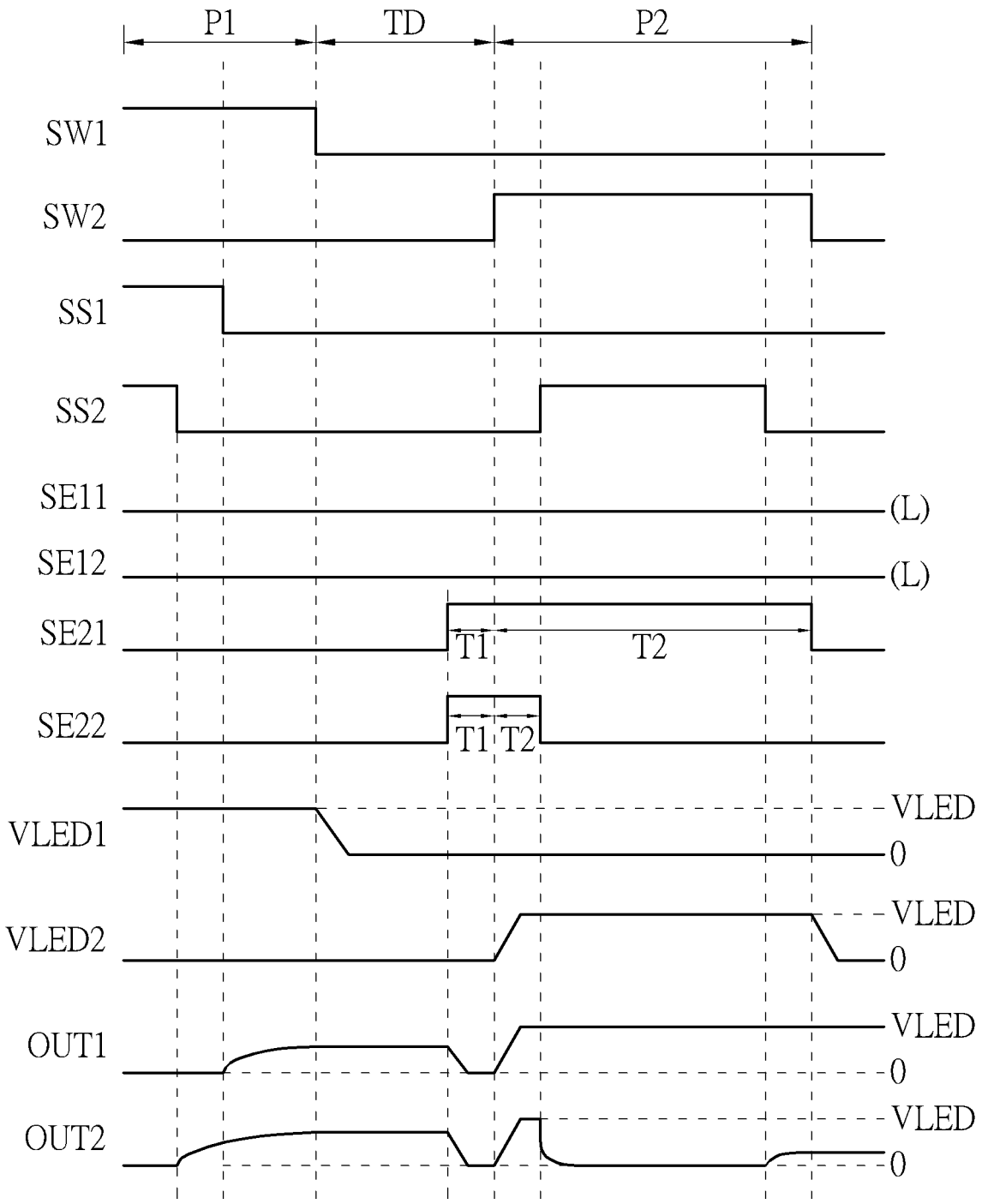
FIGS. 4A and 4B are waveform diagrams of related voltages and switch statuses as shown in FIG. 3.
Figure 4B:
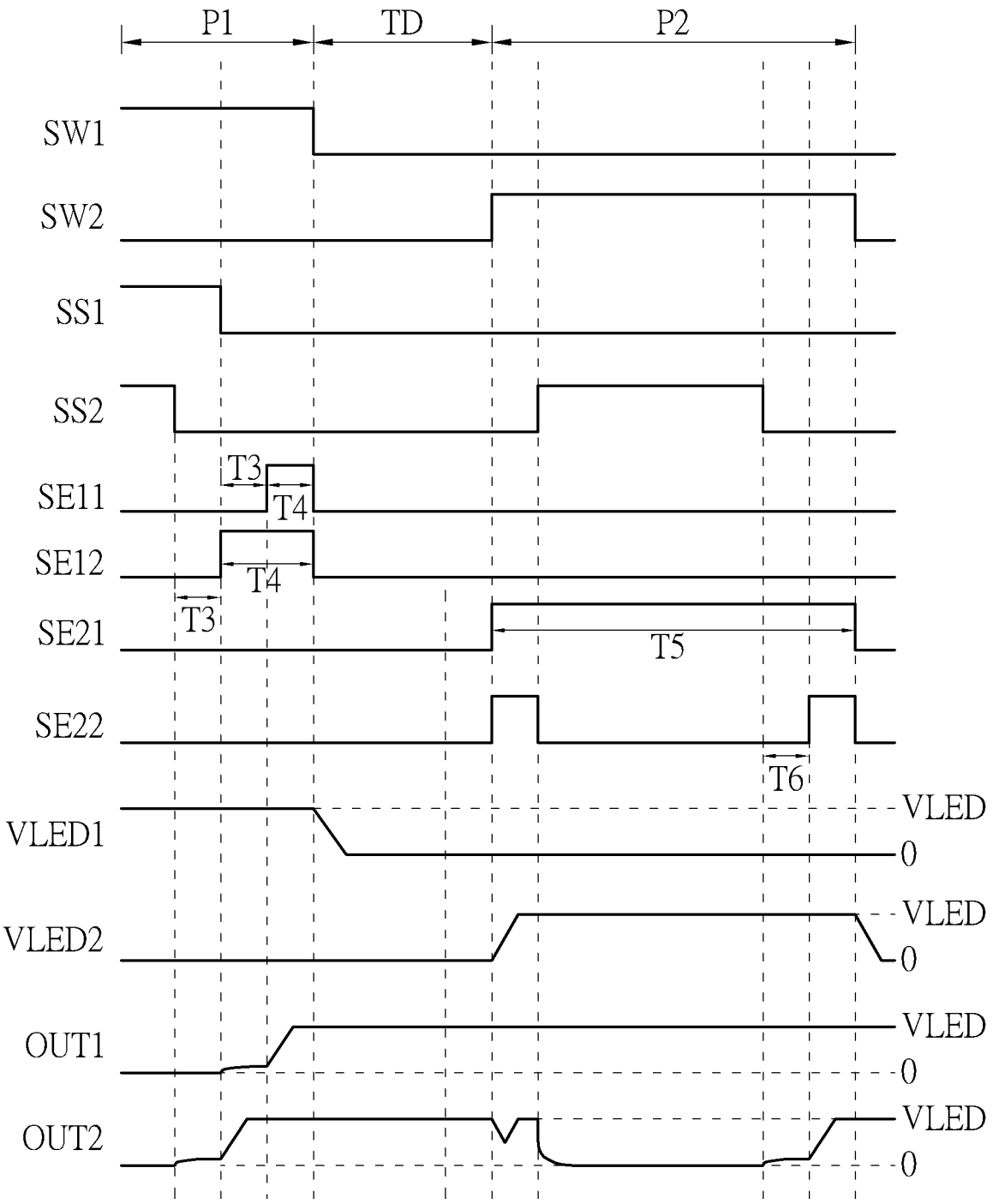

Please refer to FIGS. 4A and 4B, which are waveform diagrams of related voltages and switch statuses as shown in FIG. 3. Similar to FIG. 2, FIGS. 4A and 4B also illustrate a transition of scan periods from P1 to P2. As for the control signals of all switches in the display device 30, the "high" pulse stands for turned-on and the "low" pulse stands for turned-off.

As shown in FIG. 4A, during the scan period P1, both of the LEDs D11 and D12 are configured to emit light, and thus both of the emission switches SS1 and SS2 are turned on. The turned-on switches SS1 and SS2 may control the nodes OUT1 and OUT2 (which is respectively coupled to the cathode of the LEDs D11 and D12) to achieve a lower voltage approximately equal to zero voltage, allowing the LEDs D11 and D12 to be fully turned on to emit light. The voltages of the nodes OUT1 and OUT2 gradually rise after the emission switches SS1 and SS2 are turned off, but the voltage of the node OUT1 remains at a lower level, as similar to the situation shown in FIG. 2. Before the turned-on time of the scan switch SW2 in the next scan period P2, the short-circuit switches SE21 and SE22 coupled to the scan line SL2 and the scan switch SW2 are turned on; hence, a short-circuit path is generated between the scan line SL2 and the nodes OUT1 and OUT2. As a result, the voltages of the nodes OUT1 and OUT2 may start to follow the voltage of the node VLED2 on the scan line SL2 (as the period T1). After the scan switch SW2 is turned on in the scan period P2, the voltages of the nodes OUT1 and OUT2 are pulled up following the node VLED2 (as the period T2). In other words, the cathode voltages of the LEDs D21 and D22 rise following their anode voltages, and thus the forward-bias voltage of the LEDs D21 and D22 may be zero; hence, the LEDs D21 and D22 may not be turned on to emit down-ghost images. Afterwards, the emission switch SS2 is turned on since the LED D22 is configured to emit light in the scan period P2. At this moment, the short-circuit switch SE22 should be turned off, in order not to influence the normal display of the LED D22. On the other hand, since the LED D21 is configured to not emit light in the scan period P2, the turned-on period of the short-circuit switch SE21 may last until the scan period P2 ends.

FIG. 4B illustrates another possible control method of the short-circuit switches. As shown in FIG. 4B, there is an unused period after the emission time of the LED and before the end of the scan period P1, and the short-circuit operation may be performed in this period. In detail, after the emission switches SS1 and SS2 are turned off and then a period T3 is gone through, the short-circuit switches SE11 and SE12 are turned on, respectively, and then turned off at the end of the scan period P1, e.g., on the turned-off time of the scan switch SW1. With the turned-on short-circuit switches SE11 and SE12 in the scan period P1, the voltages of the nodes OUT1 and OUT2 are pulled up following the node VLED1 (as the period T4). The delay period T3 before the turned-on time of the short-circuit switches SE11 and SE12 may prevent the short-circuit operations from influencing the display operations of the LEDs D11 and D12.

Alternatively or additionally, the short-circuit switches SE21 and SE22 may be turned on at the start of the scan period P2. Since the LED D21 is configured to not emit light in the scan period P2, the corresponding short-circuit switch SE21 may be turned on for the entire scan period P2 (as the period T5). On the other hand, the LED D22 is configured to emit light in the scan period P2; hence, the short-circuit switch SE22 may be turned off when the emission time starts, and then turned on after the emission switch SS2 is turned off and then a period T6 is gone through, in order not to influence the display operation of the LED D22. As a result, the voltages of the nodes OUT1 and OUT2 may continuously remain at a higher level during the periods where the corresponding LEDs are configured to not emit light, which keep the forward-bias voltage of the LEDs at zero or a lower level; hence, the LEDs may not be unwantedly turned on to generate down-ghost images.

Please note that the present invention aims at providing a level adjustment circuit included in a control circuit fora display device and panel. Those skilled in the art may make modifications and alternations accordingly. For example, the abovementioned timing relations of the short-circuit switches and related emission switches and scan switches are merely several possible implementations among various embodiments of the present invention. The turned-on periods of the short-circuit switches may be adjusted or finely turned without influencing the short-circuit operations. As long as the voltage of the nodes OUT1, OUT2 . . . may be controlled to keep at a higher level that may not be able to turn on the corresponding LEDs during non-emission periods of the LEDs, control of the level adjustment circuit and the short-circuit switches may be performed in any manner. In addition, the applications of the control circuit of the present invention may not be limited to a LED panel, and other type of panel having an array of light-emitting elements may also be applicable. In another embodiment, the level adjustment circuit may be implemented with another circuit structure, as described in the following paragraphs.

Figure 5:
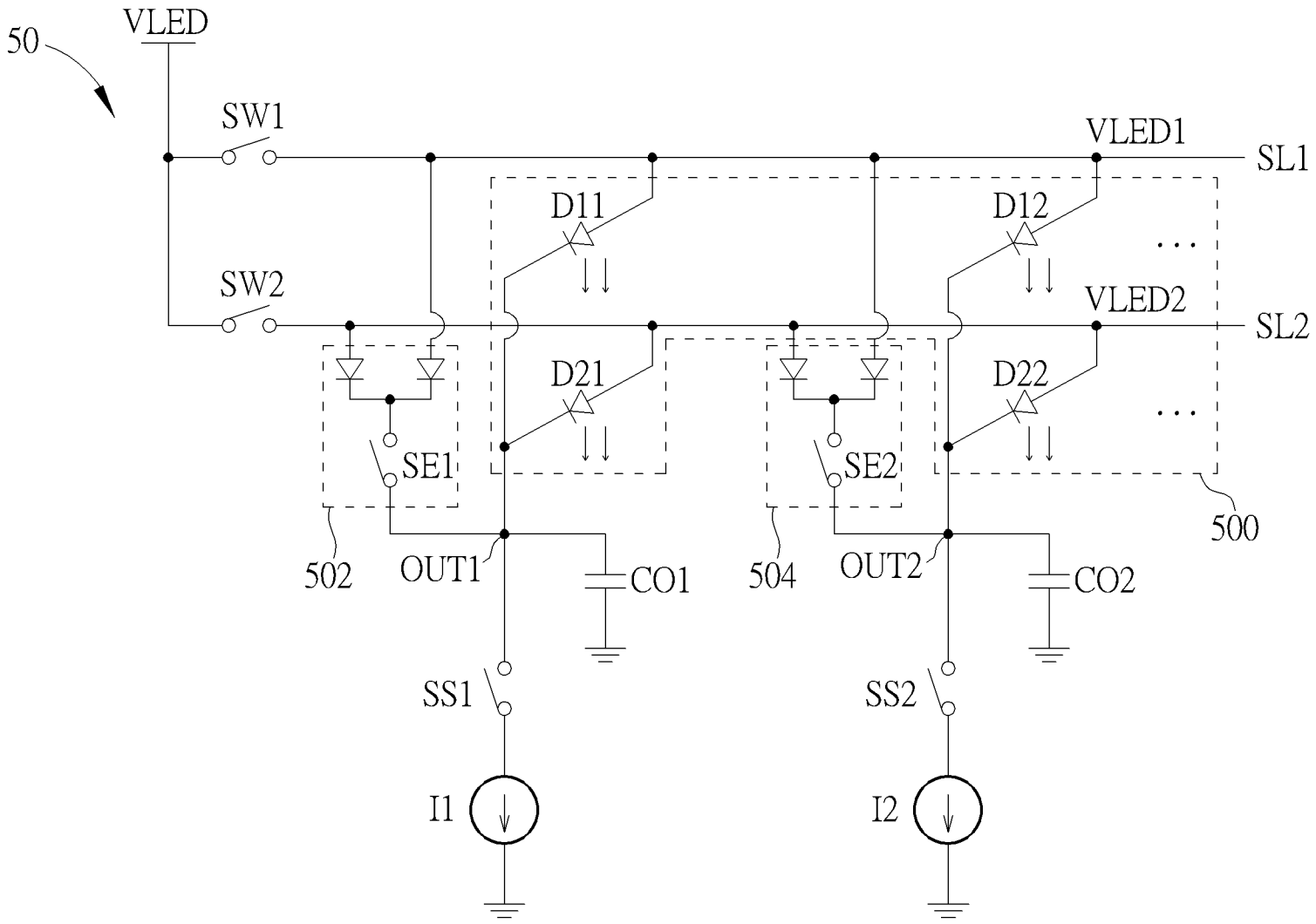
FIG. 5 is a schematic diagram of a display device according to an embodiment of the present invention.

Please refer to FIG. 5, which is a schematic diagram of a display device 50 according to an embodiment of the present invention. As shown in FIG. 5, the display device 50 includes a panel 500, level adjustment circuits 502 and 504, and several circuit elements, which are identical to the circuit elements in the display device 30 shown in FIG. 3 and thus denoted by the same symbols. The difference between the display device 50 and the display device 30 is that, in the display device 50, each of the level adjustment circuits 502 and 504 includes only one short-circuit switch SE1 or SE2 coupled to a plurality of diodes. The short-circuit switches SE1 and SE2 are coupled to the corresponding current source I1 and I2 via the emission switches SS1 and SS2, respectively. Each of the diodes is coupled between one of the short-circuit switches SE1 and SE2 and one of the corresponding scan lines SL1, SL2 . . . . Thus, the cathode of the LEDs has a short-circuit path connected to each scan line via a short-circuit switch connected with a diode in the level adjustment circuit.

Please note that the diode in the level adjustment circuits is a general circuit element applied to clamp a voltage in an IC, such as a Zener diode, while a LED is a diode capable of emitting light. Although these diodes have similar symbols, they are different circuit elements and have different functionality in the embodiments of the present invention.

In general, in the circuit layout, the area of a switch is larger than the area of a diode; hence, in the display device 50, additional short-circuit switches are replaced by the diodes, which has the benefit of lower circuit area without influencing the short-circuit operation of the present invention. For example, if the panel 500 has M rows of LEDs, each level adjustment circuit may include M diodes and 1 short-circuit switch. If the panel 500 has N columns of LEDs, there may be N level adjustment circuits disposed in the display device 50. Therefore, the level adjustment circuits of the display device 50 totally include M×N diodes and N short-circuit switches. In comparison, with the structure of the display device 30, if the panel 300 has M rows and N columns of LEDs, there may be N level adjustment circuits disposed in the display device 30 and each level adjustment circuit has M short-circuit switches. Therefore, the level adjustment circuits of the display device 30 totally include M×N short-circuit switches. As a result, the number of short-circuit switches in the display device 50 is divided by M compared to the display device 30, which leads to a significant reduction of the circuit area. Although M×N diodes are included, the circuit structure of the level adjustment circuits in the display device 50 may still achieve less circuit area and circuit costs since the area of the diode is smaller than the area of the switch.

Figure 6A:
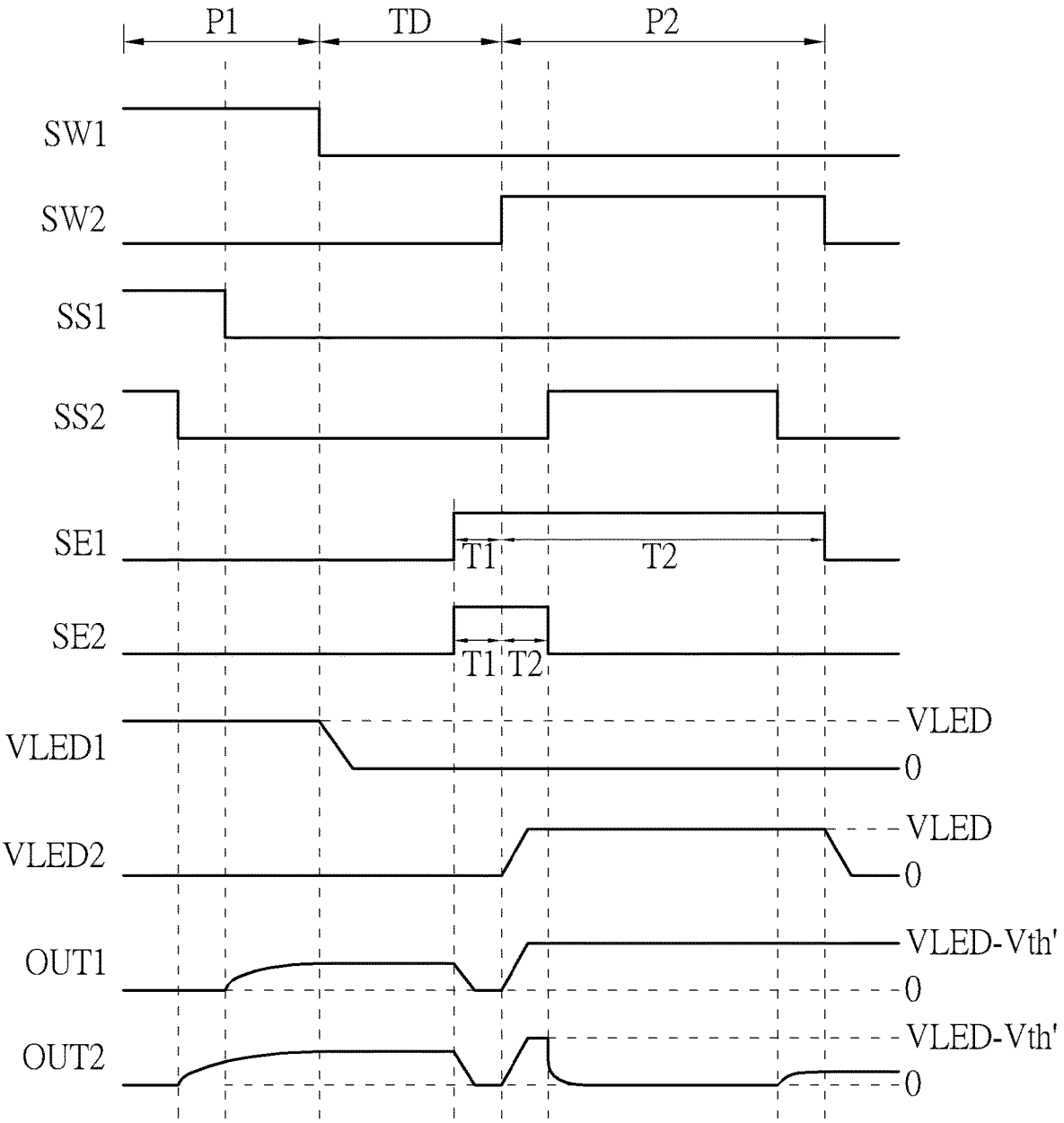
FIGS. 6A and 6B are waveform diagrams of related voltages and switch statuses as shown in FIG. 5.
Figure 6B:
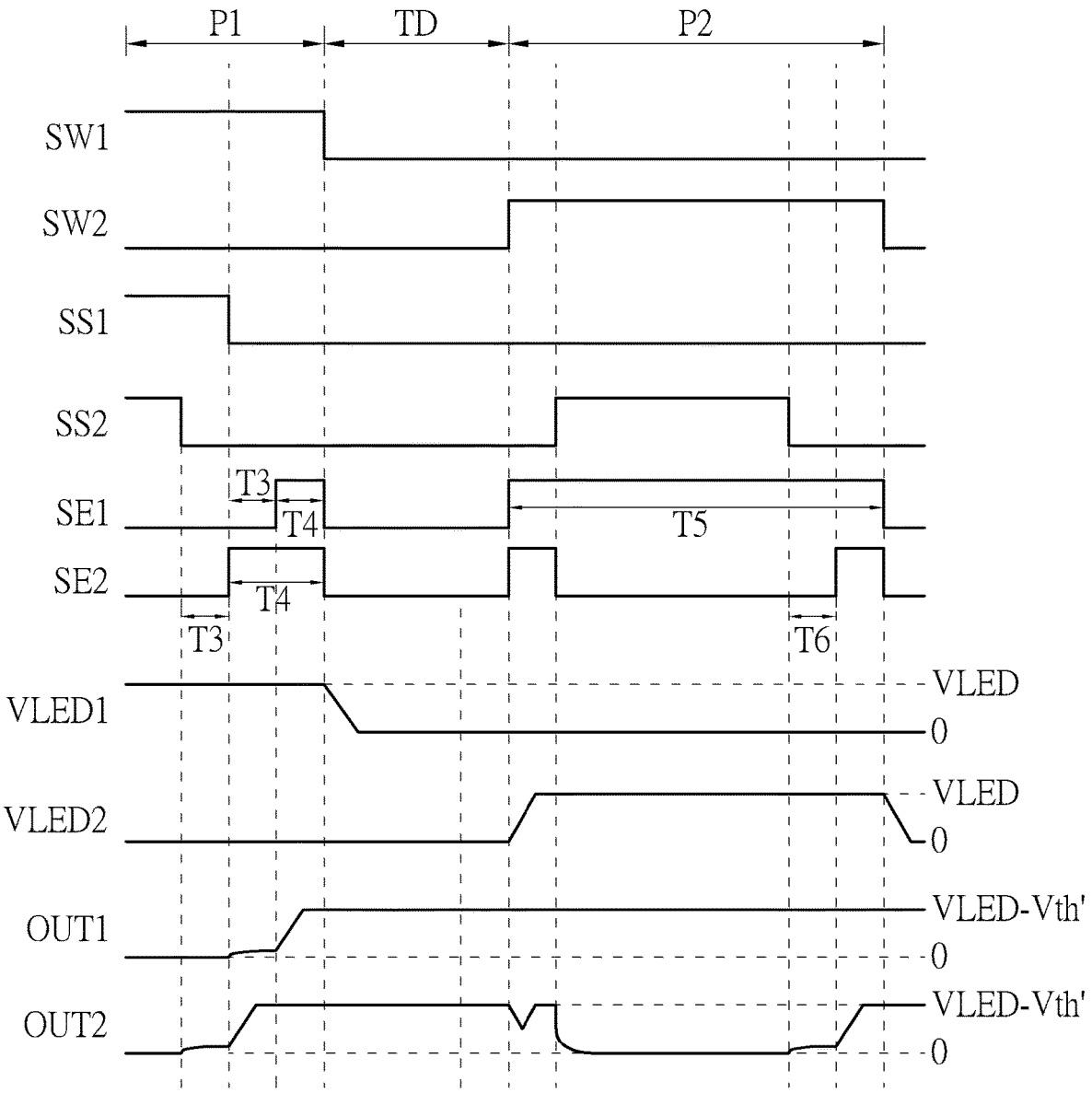

Please refer to FIGS. 6A and 6B, which are waveform diagrams of related voltages and switch statuses as shown in FIG. 5. FIGS. 6A and 6B also illustrate a transition of scan periods from P1 to P2. As for the control signals of all switches in the display device 50, the "high" pulse stands for turned-on and the "low" pulse stands for turned-off.

FIG. 6A illustrates display configurations and short-circuit operations similar to FIG. 4A. The short-circuit switches SE1 and SE2 are turned on before the turned-on time of the scan switch SW2 in the scan period P2, in order to generate short-circuit paths between the scan line SL2 and the nodes OUT1 and OUT2, respectively. As a result, the voltages of the nodes OUT1 and OUT2 may start to follow the voltage of the node VLED2 on the scan line SL2 (as the period T1). After the scan switch SW2 is turned on in the scan period P2, the voltages of the nodes OUT1 and OUT2 are pulled up following the node VLED2 (as the period T2). In detail, the nodes OUT1 and OUT2 may be pulled up to a voltage level equal to the power supply voltage VLED minus the threshold voltage Vth' of the diodes in the level adjustment circuits 502 and 504. As long as the threshold voltage Vth' of the diodes in the level adjustment circuits 502 and 504 is configured to be smaller than the threshold voltage Vth of the LED, the LED may not be forward biased to emit down-ghost images when the corresponding short-circuit switch is turned on. Other diodes except for the diode coupled to the scan line SL2 are turned off because other scan lines are at the zero voltage which allows these diodes to be reversely biased. Therefore, only the short-circuit path between the scan line SL2 and each of the nodes OUT1 and OUT2 is conducted, and other diodes may not influence the short-circuit operation in this scan period.

The configurations of turned-on time and turned-off time of the short-circuit switches SE1 and SE2 in the level adjustment circuits 502 and 504 are similar to the configurations of the short-circuit switches SE21 and SE22 as shown in FIG. 3 and FIG. 4A. Therefore, those skilled in the art may understand the detailed operations of the short-circuit switches SE1 and SE2 based on the descriptions mentioned above; these will not be detailed herein.

FIG. 6B illustrates display configurations and short-circuit operations similar to FIG. 4B. During the scan period P1, the short-circuit switches SE1 and SE2 are turned on after the turned-off time of the emission switches SS1 and SS2, respectively, with a delay period T3, in order to generate short-circuit paths between the scan line SL1 and the nodes OUT1 and OUT2, respectively. The delay period T3 may prevent the short-circuit operations from influencing the display operations of the LEDs D11 and D12. As a result, the voltages of the nodes OUT1 and OUT2 may start to follow the voltage of the node VLED1 on the scan line SL1 (as the period T4). After the scan switch SW2 is turned on in the scan period P2, the voltages of the nodes OUT1 and OUT2 are pulled up following the node VLED2 (as the period T5). In detail, the nodes OUT1 and OUT2 may be pulled up to a voltage level equal to the power supply voltage VLED minus the threshold voltage Vth' of the diodes in the level adjustment circuits 502 and 504. The threshold voltage Vth' of the diodes in the level adjustment circuits 502 and 504 should be smaller than the threshold voltage Vth of the LEDs, so that the LEDs may not be forward biased to emit down-ghost images when the corresponding short-circuit switch is turned on.

In the next scan period P2, the short-circuit switches SE1 and SE2 may be turned on at the start of the scan period P2. The short-circuit switch SE1 may be turned on for the entire scan period P2 since the LED D21 is configured to not emit light in the scan period P2. The short-circuit switch SE22 may be turned off during the emission time and then turned on after the emission time ends (i.e., the emission switch SS2 is turned off) and a period T6 is gone through, in order not to influence the display operation of the LED D22. Note that in the level adjustment circuit 502 or 504, there is only one short-circuit switch SE1 or SE2. The short-circuit switches SE1 and SE2 may operate similar to the short-circuit switches SE11 and SE12 in the level adjustment circuits 302 and 304 of the display device 30 during the scan period P1 and operate similar to the short-circuit switches SE21 and SE22 in the level adjustment circuits 302 and 304 of the display device 30 during the scan period P2, respectively. As a result, the level adjustment circuits in the display device 50 may realize similar short-circuit functions as those realized by the level adjustment circuits in the display device 30, while having the benefits of lower circuit area and costs.

Figure 7:
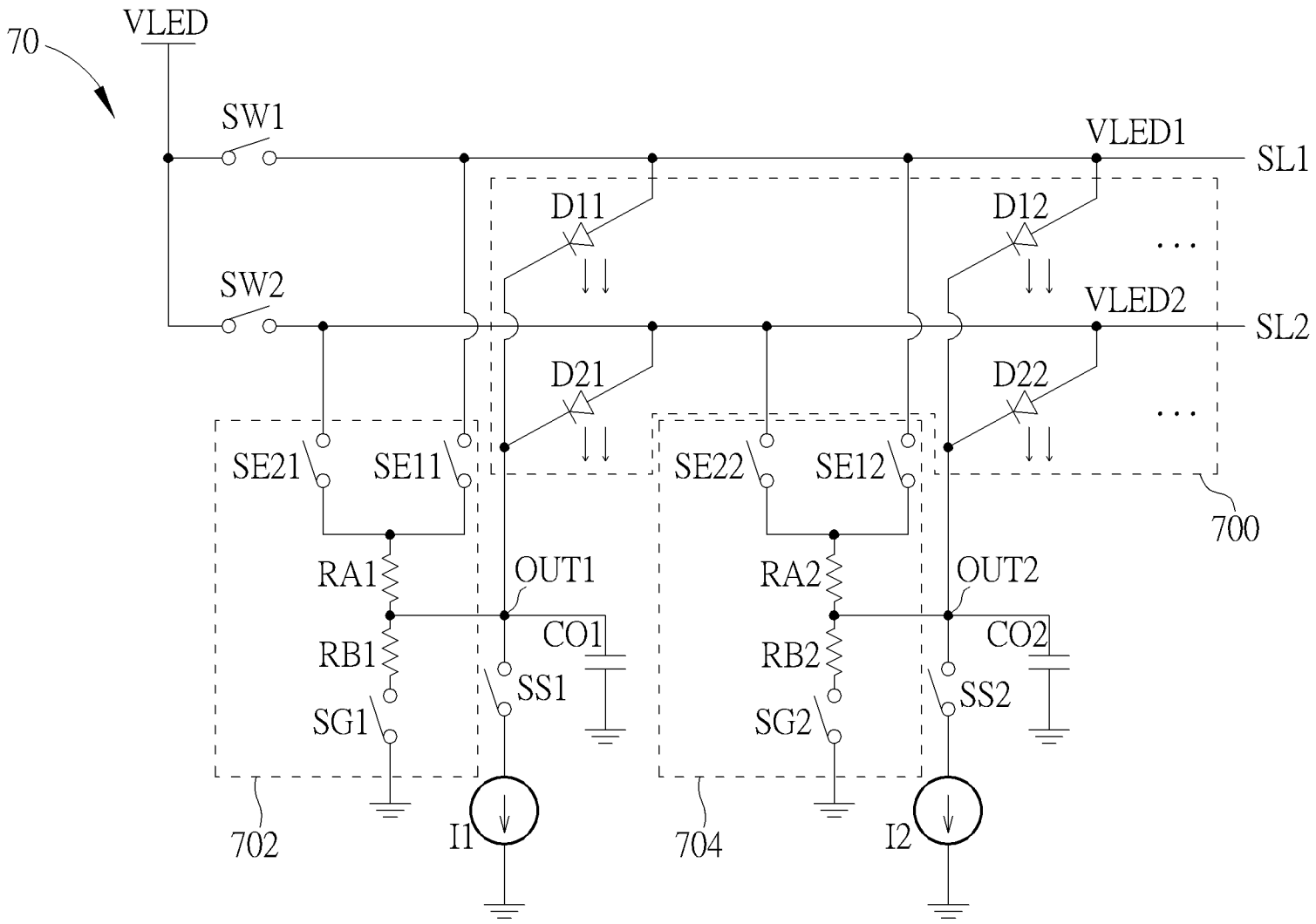
FIG. 7 is a schematic diagram of another display device according to an embodiment of the present invention.

Please refer to FIG. 7, which is a schematic diagram of another display device 70 according to an embodiment of the present invention. As shown in FIG. 7, the display device 70 includes a panel 700, level adjustment circuits 702 and 704, and several circuit elements, which are identical to the circuit elements in the display device 30 shown in FIG. 3 and thus denoted by the same symbols. The difference between the display device 70 and the display device 30 is that, in the display device 70, each of the level adjustment circuits 702 and 704 includes voltage dividing resistors in addition to the short-circuit switches. In detail, the level adjustment circuit 702 includes short-circuit switches SE11 and SE21, resistors RA1 and RB1, and a control switch SG1, and the level adjustment circuit 704 includes short-circuit switches SE12 and SE22, resistors RA2 and RB2, and a control switch SG2. The voltage dividing resistors RA1 and RB1 are coupled between the current source I1 and the short-circuit switches SE11 and SE21. The voltage dividing resistors RA2 and RB2 are coupled between the current source I2 and the short-circuit switches SE12 and SE22.

Figure 8A:
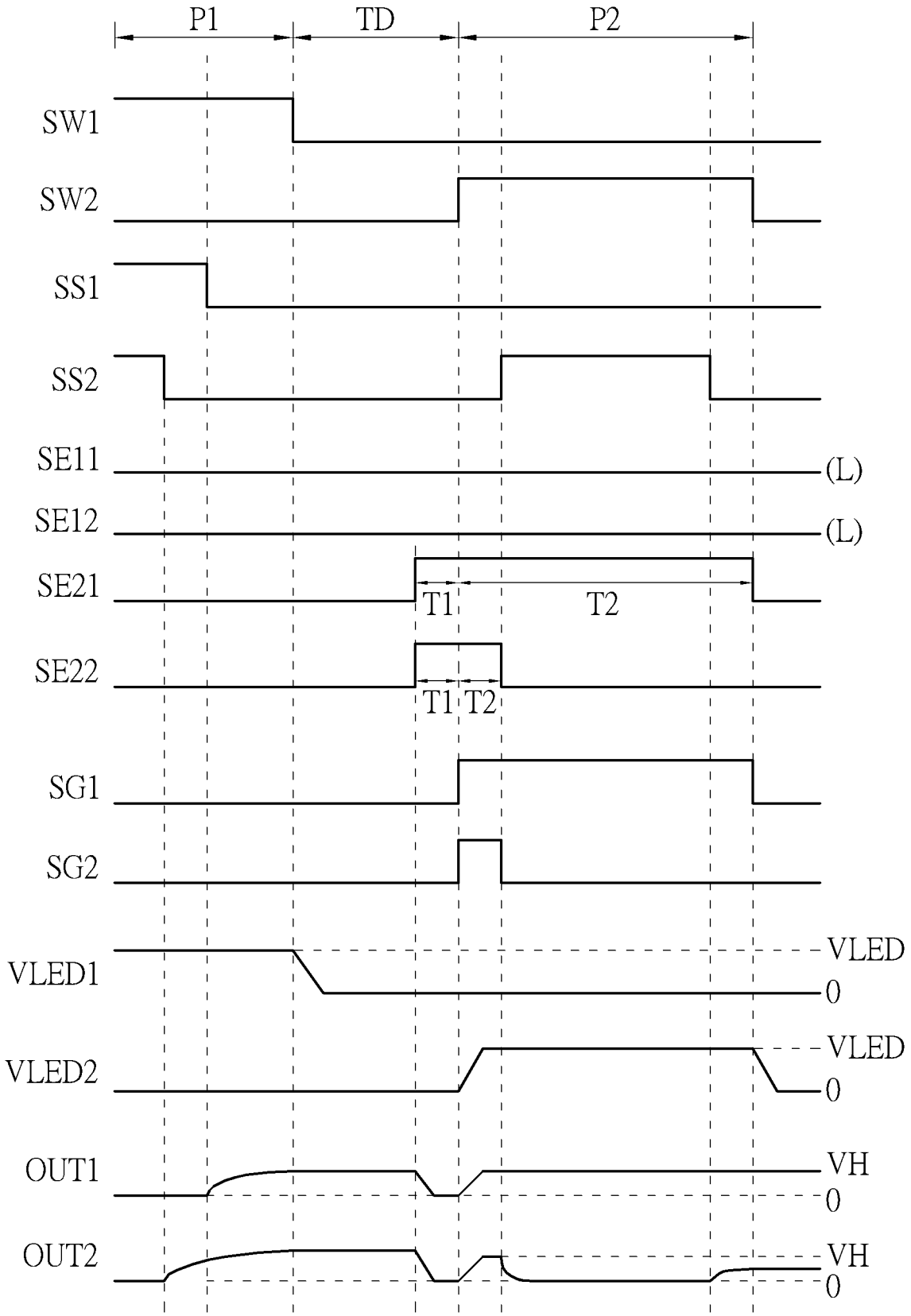
FIGS. 8A and 8B are waveform diagrams of related voltages and switch statuses as shown in FIG. 7.
Figure 8B:
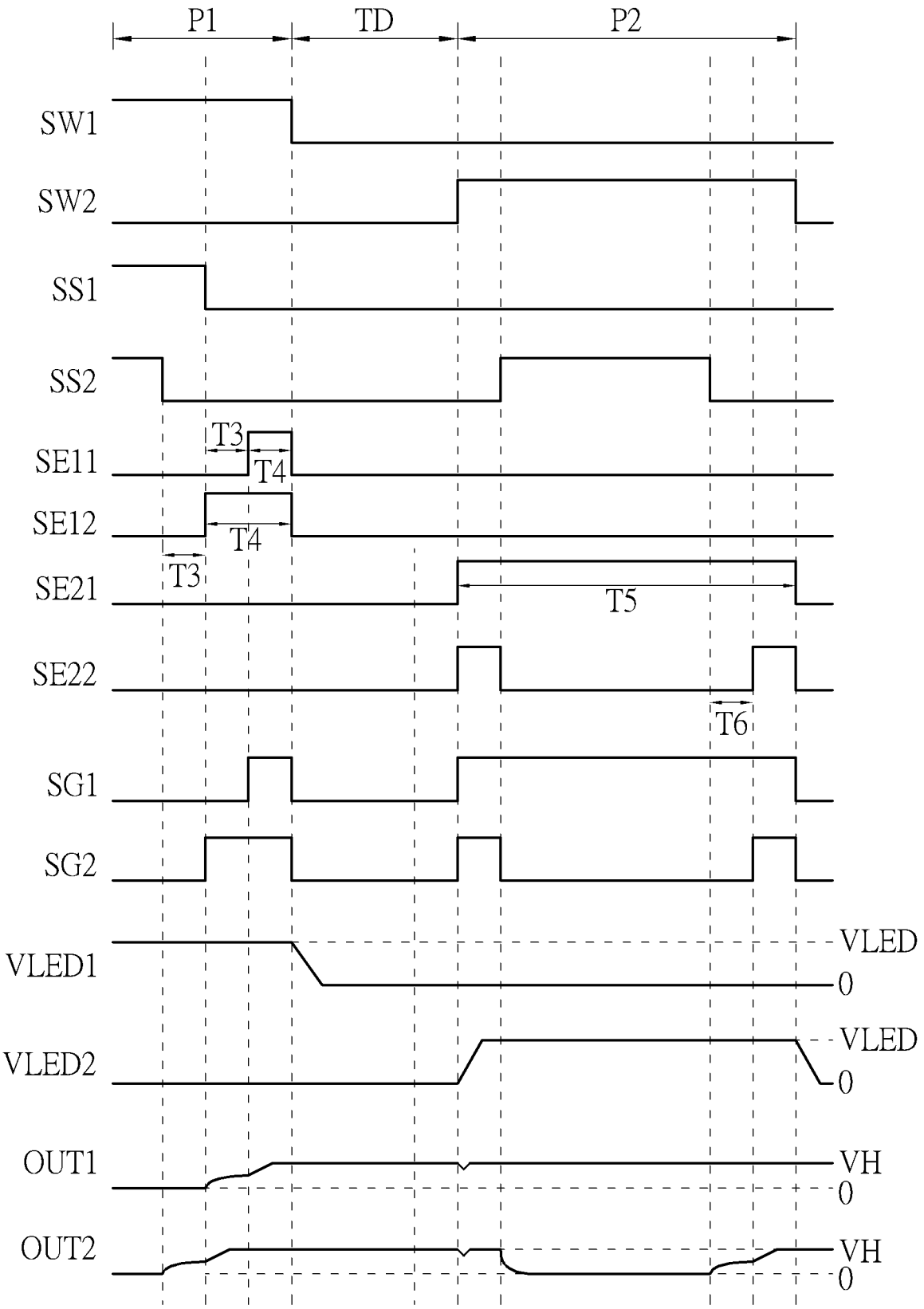

Please refer to FIGS. 8A and 8B, which are waveform diagrams of related voltages and switch statuses as shown in FIG. 7. FIGS. 8A and 8B also illustrate a transition of scan periods from P1 to P2. As for the control signals of all switches in the display device 70, the "high" pulse stands for turned-on and the "low" pulse stands for turned-off.

FIG. 8A illustrates display configurations and short-circuit operations similar to FIG. 4A. During the scan period P2, the operations of the short-circuit switches SE21 and SE22 are identical to those illustrated in FIG. 4A and related paragraphs, and will not be narrated herein. When the scan period P2 starts, the control switches SG1 and SG2 are turned on at the turned-on time of the scan switch SW2. The control switches SG1 and SG2 activate the operations of the voltage dividing resistors; hence, the voltages of the nodes OUT1 and OUT2 are pulled up to a higher voltage VH rather than the power supply voltage VLED. The voltage VH may be lower than the power supply voltage VLED, and should be higher enough to turn off the LEDs D21 and D22 during the non-emission time of the scan period P2; that is, the difference between the voltage VH and the power supply voltage VLED should be smaller than the threshold voltage Vth of the LEDs D21 and D22.

Please refer back to FIGS. 3 and 4A. During the scan period P2, the voltages of the nodes OUT1 and OUT2 (i.e., the cathode voltages of the LEDs) are pulled up to the level VLED. Meanwhile, the scan lines other than SL2 are at the zero voltage level. For example, the voltage of the node VLED1 on the scan line SL1 is zero, as shown in FIG. 4A. This results in a larger reverse-bias voltage VLED on the LEDs D11 and D12 coupled to the scan line SL1. Note that an excessive reverse-bias voltage exerted on an LED may reduce the lifespan of the LED. Therefore, it is preferable to pull the voltages of the nodes OUT1 and OUT2 to a proper level, which is able to turn off the corresponding LEDs to prevent unwanted light emission and down-ghost images without generating excessive reverse-bias voltage on the LEDs of other scan lines. The implementations of the level adjustment circuit including voltage dividing resistors may achieve this purpose.

FIG. 8B illustrates display configurations and short-circuit operations similar to FIG. 4B. The operations of the short-circuit switches SE11, SE12, SE2*l* and SE22 are identical to those illustrated in FIG. 4B and related paragraphs, and will not be narrated herein. The control switches SG1 and SG2 are turned on following the corresponding short-circuit switches. With the voltage dividing resistors, the voltages of the nodes OUT1 and OUT2 are pulled up to the voltage VH rather than the power supply voltage VLED. The voltage level VH on the cathode voltage of the LEDs may prevent unwanted light emission and down-ghost images without generating an excessive reverse-bias voltage on the LEDs coupled to other scan lines.

Figure 9:
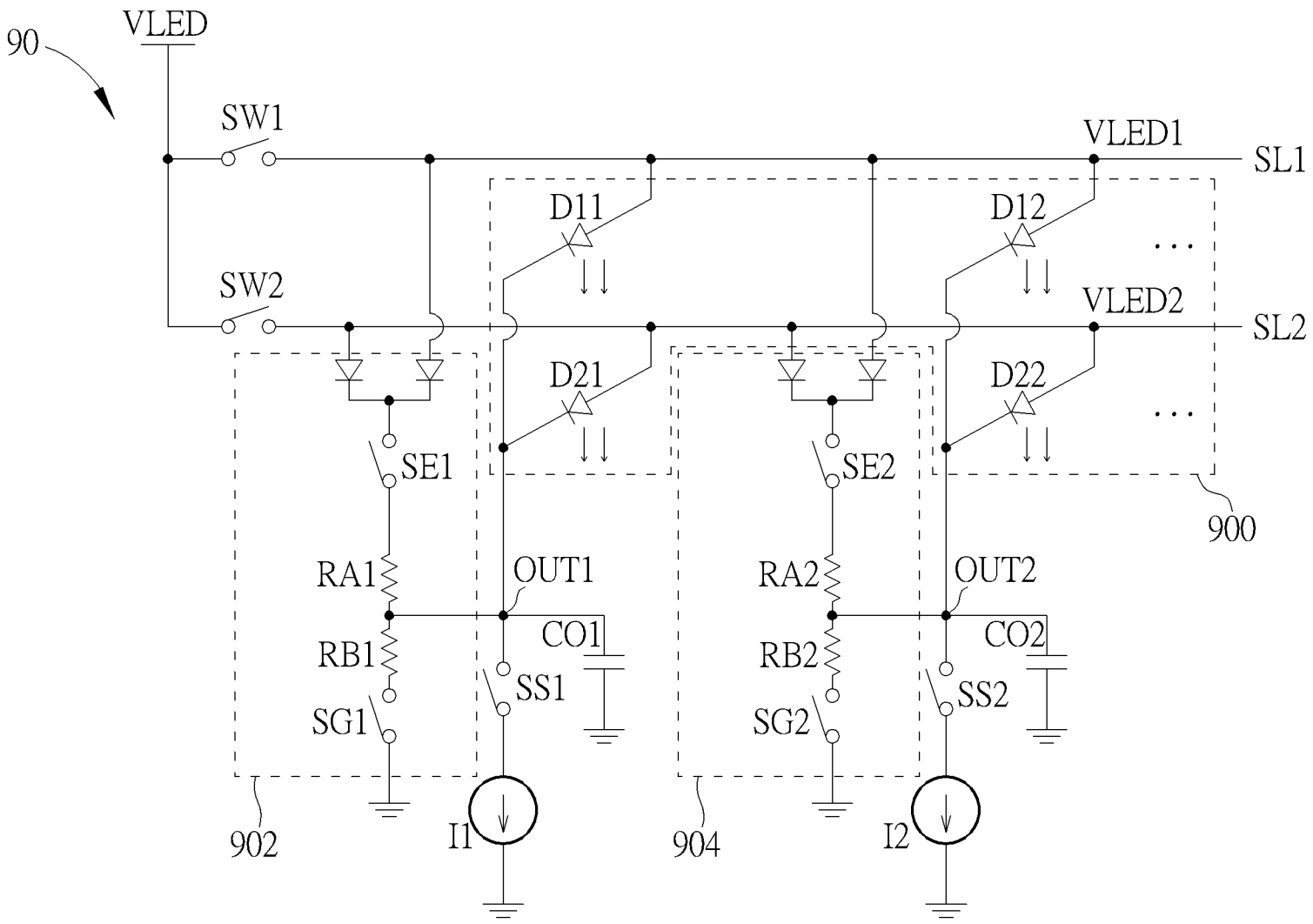
FIG. 9 is a schematic diagram of a further display device according to an embodiment of the present invention.

Please refer to FIG. 9, which is a schematic diagram of a further display device 90 according to an embodiment of the present invention. As shown in FIG. 9, the display device 90 includes a panel 900, level adjustment circuits 902 and 904, and several circuit elements, which are identical to the circuit elements in the display device 50 shown in FIG. 5 and thus denoted by the same symbols. The difference between the display device 90 and the display device 50 is that, in the display device 90, each of the level adjustment circuits 902 and 904 includes voltage dividing resistors in addition to the short-circuit switch and the diodes. In detail, the level adjustment circuit 902 includes a short-circuit switch SE1, a plurality of diodes, resistors RA1 and RB1, and a control switch SG1, and the level adjustment circuit 704 includes a short-circuit switch SE2, a plurality of diodes, resistors RA2 and RB2, and a control switch SG2. The voltage dividing resistors RA1 and RB1 are coupled between the current source I1 and the short-circuit switch SE1. The voltage dividing resistors RA2 and RB2 are coupled between the current source I2 and the short-circuit switch SE2.

Figure 10A:
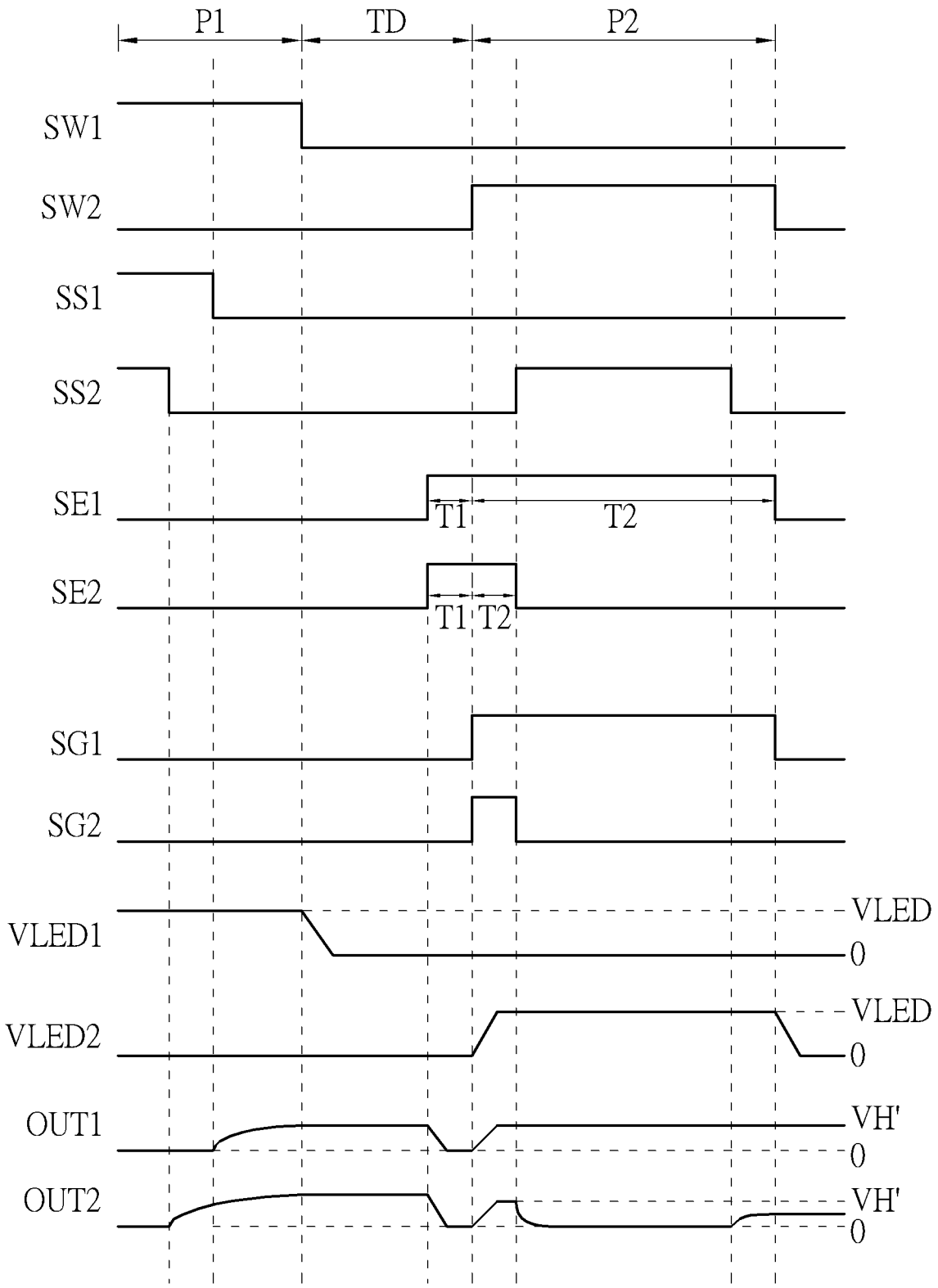
FIGS. 10A and 10B are waveform diagrams of related voltages and switch statuses as shown in FIG. 9.
Figure 10B:
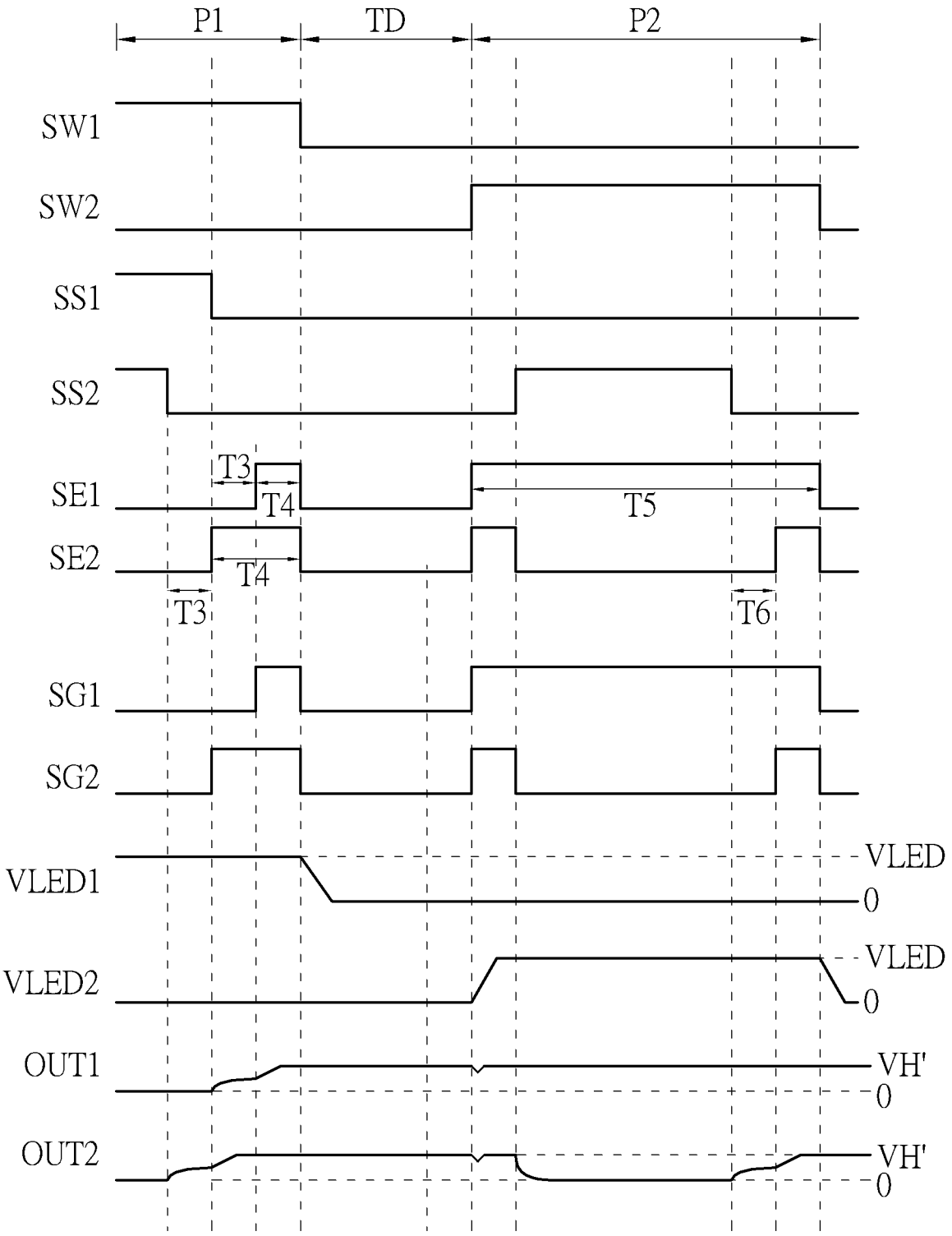

Please refer to FIGS. 10A and 10B, which are waveform diagrams of related voltages and switch statuses as shown in FIG. 9. FIGS. 10A and 10B also illustrate a transition of scan periods from P1 to P2. As for the control signals of all switches in the display device 90, the "high" pulse stands for turned-on and the "low" pulse stands for turned-off.

As shown in FIG. 9 and FIGS. 10A and 10B, the level adjustment circuits 902 and 904 are implemented as the structure of the level adjustment circuits 502 and 504 joined with voltage dividing resistors. Therefore, when the short-circuit switch SE1 or SE2 and the corresponding control switch SG1 or SG2 are turned on, the voltages of the nodes OUT1 and OUT2 may be pulled to a higher voltage VH', which prevents the LEDs from emitting unwanted light and generating down-ghost images without generating an excessive reverse-bias voltage on the LEDs coupled to other scan lines. The voltage VH' may be well controlled to a proper level based on the threshold voltage of the diodes in the level adjustment circuits and the resistance values of the voltage dividing resistors. The detailed operations of the switch controls and related waveforms shown in FIGS. 10A and 10B are similar to those described in the above paragraphs, and will not be narrated herein.

To sum up, the present invention provides a control circuit for a panel (such as a LED panel) and a related display device, which are capable of solving the down-ghost problem. The control circuit includes a level adjustment circuit, which controls the cathode voltage of the LEDs to a higher level, allowing the LEDs to be turned off during a non-emission period of the LED in a scan period. Therefore, the LEDs may not be unwantedly turned on to emit down-ghost images. In an embodiment, the cathode of the LEDs may be coupled to the scan line via a short-circuit switch; hence, the cathode voltage may be pulled to a higher level when the short-circuit switch is turned on. In an embodiment, an array of short-circuit switches may be replaced by a single short-circuit switch coupled to diodes, so as to reduce the circuit area. In an embodiment, the short-circuit switch may further be coupled to voltage dividing resistors, which control the cathode voltage of the LED to achieve a proper level, which is able to turnoff the LED without generating excessive reverse-bias voltage on the LEDs coupled to other scan lines. With the above embodiments, the down-ghost problem of the panel may be effectively solved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A control circuit for controlling a panel, the panel comprising a plurality of light-emitting elements arranged as an array, each row of light-emitting elements among the plurality of light-emitting elements coupled to each other via one of a plurality of scan lines, the control circuit comprising:

a current source, coupled to a column of light-emitting elements among the plurality of light-emitting elements;

an emission switch, coupled to the current source and the column of light-emitting elements;

a plurality of scan switches, each coupled to one of the column of light-emitting elements via one of the plurality of scan lines; and a level adjustment circuit, coupled between the plurality of scan lines and the current source;

wherein the level adjustment circuit comprises:

a plurality of short-circuit switches, each short-circuit switch coupled between the current source and one scan switch of the plurality of scan switches and each short-circuit switch is connected electrically in parallel with one light-emitting element of the plurality of light-emitting elements;

wherein each short-circuit switch of the plurality of short circuit switches provides a short-circuit path between a scan line of the plurality of scan lines and a cathode of a target light-emitting element thereby allowing the cathode and anode of the target light-emitting element to be short-circuited such that the target light-emitting element does not emit light to generate a ghost image.

2. The control circuit of claim 1, wherein the level adjustment circuit is configured to control a voltage level of a node coupled between the column of light-emitting elements and the current source.

3. The control circuit of claim 1, wherein a short-circuit switch among the plurality of short-circuit switches is turned on before a turned-on time of a scan switch coupled to the short-circuit switch among the plurality of scan switches.

4. The control circuit of claim 1, wherein a short-circuit switch among the plurality of short-circuit switches is turned on after a turned-off time of the emission switch and turned off on a turned-off time of a scan switch coupled to the short-circuit switch among the plurality of scan switches.

5. The control circuit of claim 1, wherein the level adjustment circuit further comprises: a plurality of voltage dividing resistors, coupled between the current source and the plurality of short-circuit switches.

6. The control circuit of claim 1, wherein the level adjustment circuit comprises:

a short-circuit switch, coupled to the current source; and a plurality of diodes, each coupled between the short-circuit switch and one of the plurality of scan lines.

7. The control circuit of claim 6, wherein the short-circuit switch is turned on before a turned-on time of a scan switch among the plurality of scan switches.

8. The control circuit of claim 6, wherein the short-circuit switch is turned on after a turned-off time of the emission switch and turned off on a turned-off time of a scan switch among the plurality of scan switches.

9. The control circuit of claim 6, wherein the level adjustment circuit further comprises:

a plurality of voltage dividing resistors, coupled between the current source and the short-circuit switch.

* * * * *